US005662778A

United States Patent [19]

Laapotti

[11] Patent Number: 5,662,778

[45] Date of Patent: Sep. 2, 1997

[54] PRESS SECTION WITH AN EQUALIZING NIP IN A PAPER MACHINE

[75] Inventor: Jorma Laapotti, Palokka, Finland

[73] Assignee: Valmet Corporation, Helsinki, Finland

[21] Appl. No.: 540,084

[22] Filed: Oct. 6, 1995

[30] Foreign Application Priority Data

Oct. 6, 1994 [FI] Finland ..... 944674

[51] Int. Cl.[6] ..... D21F 3/00

[52] U.S. Cl. ..... 162/360.2; 162/358.3; 162/359.1; 162/306

[58] Field of Search ..... 162/358.3, 358.5, 162/360.2, 361, 306, 359.1

[56] References Cited

U.S. PATENT DOCUMENTS

| | | | |
|---|---|---|---|
| 4,483,745 | 11/1984 | Wicks et al. | 162/206 |
| 4,526,655 | 7/1985 | Karvinen et al. | 162/360.2 |
| 4,566,946 | 1/1986 | Koponen et al. | 162/359 |
| 4,931,143 | 6/1990 | Karvinen et al. | 162/360.1 |
| 4,943,351 | 7/1990 | Wedel | 162/307 |
| 5,389,205 | 2/1995 | Pajula et al. | 162/205 |

FOREIGN PATENT DOCUMENTS

| | | |
|---|---|---|
| 2126617 | 12/1994 | Canada . |
| 0487483 | 5/1992 | European Pat. Off. . |
| 64823 | 9/1983 | Finland . |
| 905798 | 5/1992 | Finland . |
| 3515575 | 11/1985 | Germany . |
| 9206340 | 9/1992 | Germany . |
| 4321406 | 11/1993 | Germany . |
| 2127448 | 4/1984 | United Kingdom . |

*Primary Examiner*—Karen M. Hastings
*Attorney, Agent, or Firm*—Steinberg, Raskin & Davidson, P.C.

[57] ABSTRACT

A press section in a paper machine through which a paper web has a closed and supported draw. The press section has at least two successive separate press nips and dewatering of the paper web is carried out at least in the first one of these press nips, preferably between two press fabrics that receive water. The last press nip in the press section is an equalizing press nip which is separate from the preceding nip and in which no substantial dewatering is performed. The paper web is passed through the equalizing press nip from the preceding dewatering press nip on a transfer belt substantially not receiving water, on its substantially straight run. This run is continued after the equalizing nip as a run of substantially the same direction, on which run, some of the elongation of the paper web in the machine direction is compensated for, which elongation takes place in the equalizing nip, by a difference in speed of the transfer belt.

24 Claims, 6 Drawing Sheets

PRESS SECTION WITH AN EQUALIZING NIP IN A PAPER MACHINE

FIELD OF THE INVENTION

The present invention relates to a press section in a paper machine, through which press section the paper web has a closed and supported draw. The press section comprises at least two successive separate press nips whereby dewatering of the paper web is carried out at least in the first one of the press nips, preferably between two press fabrics that receive water.

BACKGROUND OF THE INVENTION

One of the most important quality requirements of all paper and board grades is uniformity of the structure both on the micro scale and on the macro scale. The structure of paper, in particular of printing paper, must also be symmetric. The good printing properties required from printing paper mean equal good smoothness, evenness, and certain absorption properties of both faces of the web from which the paper will be produced. The properties of paper, such as the symmetry of surface roughness and density, are affected to a considerable extent by the operation of the press section of the paper machine in which the web is produced, which operation also has a decisive significance for the uniformity of the profiles of the paper in the cross direction and in the machine direction.

Increased running speeds of paper machines create new problems to be solved, which problems are mostly related to the runnability of the machine. Currently, running speeds of up to about 1500 meters per minute are employed. At these running speeds, so-called closed press sections, which comprise a compact combination of press rolls fitted around a smooth-faced center roll, usually operate satisfactorily. As examples of such press sections, reference should be made to the assignee's "Sym-Press II"™ and "Sym-Press O"™ press sections.

From the point of view of energy economy, dewatering taking place by pressing is preferable to dewatering taking place by evaporation. For this reason, attempts should be made to remove a maximum amount of water out of the paper web by pressing in order that the proportion of water to be removed by evaporation can be made as little as possible. Increased running speeds of paper machines, however, create new, so far unsolved problems expressly for the dewatering taking place by pressing, because the press impulse cannot be increased sufficiently by the means known in the prior art, above all because at high speeds the nip times remain inadequately short and, on the other hand, the peak pressure of pressing cannot be increased beyond a certain limit without destruction of the structure of the web.

In the prior art press sections, the single-felt last press nip tends to produce a poor symmetry of roughness, in particular with fine paper and with LWC and MWC base paper. The problem is manifested with particular emphasis when the press impulse is high, as is the case with an extended-nip press in the last press position. For example, with MWC base paper, with the assignee's test paper machine, when non-calendered, for top-face/bottom-face Bendtsen roughness the value 0.52 was obtained, when the press load was about 800 kN per meter in a "Sym-Belt S"™ press, the length of the press shoe was about 152 mm, and the smooth press roll was in the upper position of the single-felt press nip. The high asymmetry of roughness constitutes a limitation for the extent of press load, for the dry solids content that can be achieved, and for the wet strength.

A typical environment of application of the present invention, to which environment the present invention is, however, not restricted, is represented by the assignee's Finnish Patent Application 905798 (filed Nov. 23, 1990) and by corresponding U.S. patent application Ser. Nos. 07/795,043 and 08/026,851, the later of which matured into U.S. Pat. No. 5,389,205, the specification of which is hereby incorporated by reference herein.

It is known from the prior art to employ so-called equalizing presses in connection with various press sections, including extended-nip press sections. By means of the equalizing presses, attempts are made to equalize the above asymmetry of roughness. With respect to these prior-art equalizing presses, reference is made, for example, to the assignee's Finnish Patent No. 64,823, to the published German Patent Application No. DE 4,321,406 A1 of Messrs. J. M. Voith GmbH, and to the German Utility Model G 9,206,340.3 of Messrs. Sulzer-Escher Wyss GmbH. By means of the equalizing presses known from the papers mentioned above, it has, however, not been possible to solve the problems related to asymmetry of roughness in a satisfactory way, in particular not in connection with a supported transfer of the web. Of the cited papers mentioned above, the German Utility Model is most closely related to the present invention, in particular the embodiment illustrated in FIG. 12 in that document. In the equalizing press illustrated in FIG. 12 therein, the lower press roll 11 in the equalizing press 5/11 curves the transfer belt 12 and the web over a considerably large angle, and moreover, in connection with the same lower press roll 11, a web transfer nip has been formed by means of a suction roll. Thus, in that construction, it is impossible to make use of differences in speed, by whose means it would be possible to tighten the web after the equalizing press 5/11 so as to eliminate the effects of elongation of the web taking place in the equalizing press. Moreover, in that construction, the abrupt angle of change in direction in a sensitive area directly after the equalizing press restricts the speed of operation of the press.

OBJECTS AND SUMMARY OF THE INVENTION

Accordingly, it is an object of the present invention to provide a new and improved press section avoiding these drawbacks and further development of the prior art most closely related to the present invention.

In view of achieving the object stated above and others, the invention is mainly characterized in that the last press nip in the press section is an equalizing press nip which is separate from the preceding nip and in which no substantial dewatering is performed. The paper web is passed through the equalizing press nip from the preceding dewatering press nip on a transfer belt substantially not receiving water, on its substantially straight run, which is continued after the equalizing nip as a run of substantially the same direction. On the straight run after the equalizing nip, by means of the difference in speed of the transfer belt, it is possible to compensate for some of the elongation of the paper web in the machine direction, which elongation takes place in the equalizing nip. This compensation may be provided by regulation means which regulate a running speed of the transfer belt to compensate, in a run of the transfer belt from the equalizing nip to the transfer point to the drying wire, for the elongation of the web in the equalizing nip. The regulation means are structured and arranged to provide the transfer belt with variable speeds, a higher speed when compensation for elongation of the web is required.

In the invention, the web is transferred from the last dewatering nip in the press section, preferably an extended nip, on a transfer belt as a substantially linear run through the equalizing press so that the joint run of the transfer belt and the web continues as a substantially straight run also after the equalizing nip. On this straight run of the transfer belt and the web after the equalizing nip, the transfer belt can be extended to some extent so that the elongation of the web taking place in the equalizing press can be compensated for and the web can be kept tight and reliably in contact with the transfer belt. On the straight run of the transfer belt and the web, a convex suction-transfer sector can also be arranged favorably, on which sector the web can be transferred reliably onto the drying wire of the dryer section of the paper machine while using a minimal angle of change in direction.

In the preferred embodiment of the invention, in the equalizing press a particular equalizing-band loop is employed, by means of whose surface and elasticity properties it is possible to optimize the operation of the equalizing press and to make sure that, after the equalizing press, the web follows the same transfer band on which it was brought into the equalizing press and passed through the press as a run as straight as possible.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
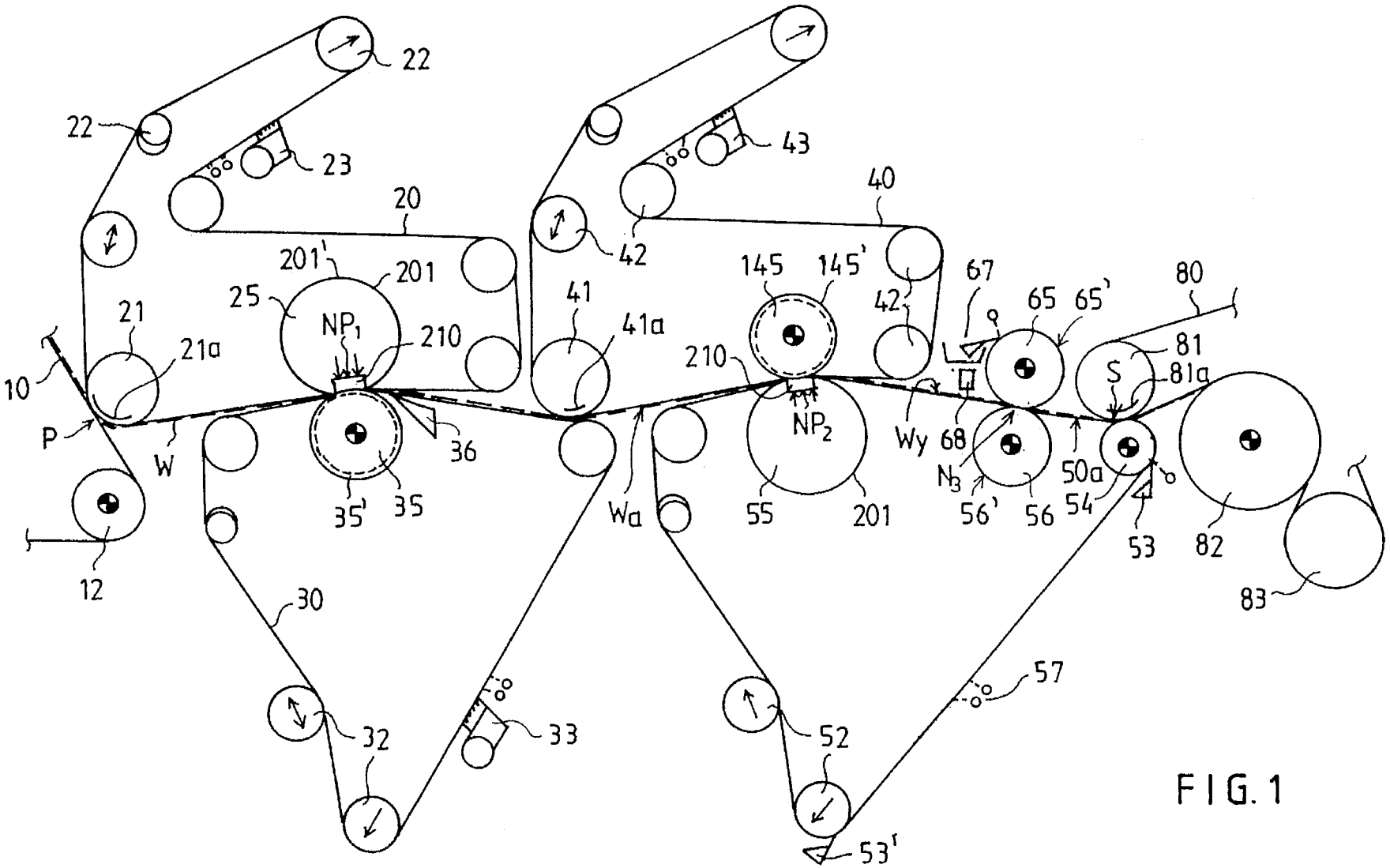
FIG. 1 is a schematic side view of a press section which is provided with a supported transfer of the web and with an equalizing press of roll nip type.

Referring to the accompanying drawings wherein the same reference numerals refer to the same or similar elements, to begin with, the common prior art features of construction of the press section geometries as shown in FIGS. 1–4 will be described. According to FIGS. 1–4, with the closed draw of the web W in the paper or board machine, the press section comprises a first upper fabric 20 which receives water, onto which fabric a web W is transferred from a preceding forming section on a suction zone 21*a* of a pick-up roll 21 at a pick-up point P from a forming wire 10, whose return run starts from a wire drive roll 12 situated after the pick-up point P. As shown in FIGS. 1–4, in the press, there are two successive press nips $NP_1$ and $NP_2$, which dewater the web W efficiently and between which the web W has a fully closed almost linear draw so that it is at all times supported by a fabric. Both of the nips $NP_1$ and $NP_2$ are so-called extended nips, whose press zone is substantially longer than that of a normal sharp roll nip.

In FIGS. 1–4, the first upper fabric 20 is guided by alignment, tensioning and guide rolls 22 and conditioned by conditioning devices 23. The first extended nip $NP_1$ includes a water-receiving lower fabric 30, which is guided by alignment, tensioning and guide rolls 32 and conditioned by conditioning devices 33. The first extended nip $NP_1$, and also the second extended nip $NP_2$, are accomplished, for example, by means of the assignee's "Sym Belt Press"™ press, the details of whose construction come out, for example, from FIG. 10 in the assignee's Finnish Patent Application 905798 referenced above. With regard to its principal features, the construction of the press is such that the extended nip $NP_1$ is composed of a flexible hose mantle 201 and a back-up roll 35. Inside the hose mantle 201, which is preferably hollow-faced 201', and inside the dewatering-fabric loop 20, there is a hydrostatically and/or hydrodynamically lubricated glide shoe 210, and the hydraulic loading means arranged in connection with the glide shoe press the glide shoe 210 against the hollow-faced 35' back-up roll 35. The back-up roll 35 is a hollow-faced 35' press roll, for example the assignee's adjustable-crown "Sym-Z Roll"™.

According to FIGS. 1–4, the press section includes a second upper fabric 40 onto which the web W is transferred as a closed, substantially linear draw by means of the suction zone 41*a* of the suction roll 41. After the first nip $NP_1$, it is ensured that the web W follows the first lower fabric 30 by means of a suction box 36 or by means of an equivalent foil arrangement. The second upper fabric 40 is guided by alignment, tensioning and guide rolls 42 and conditioned by conditioning means or devices 43.

In the second extended nip $NP_2$, an extended-nip roll 55 is placed underneath and inside the loop of a transfer belt 50, and an upper back-up roll is a hollow-faced 145' variable-crown press roll 145 which is placed inside the loop of the second upper press fabric 40. The belt mantle 201 of the extended-nip roll 55 may also be hollow-faced, and a hollow face is preferable especially in connection with a slightly permeable transfer belt 50. In the invention, the transfer belt 50 runs through the last dewatering press nip $NP_2$ and through an equalizing press nip $N_3$,$NP_3$ as an almost straight run. The transfer belt 50 is guided by guide and tensioning rolls 52 and by a drive roll 54 as well as conditioned by doctors 53 and 53' and by wash jets 57.

According to the invention, after the last extended nip $NP_2$, in connection with the transfer belt, the equalizing nip $N_3$,$NP_3$ is arranged after which the web W is passed as an almost linear closed draw on the transfer belt 50 to a transfer point S and further onto a drying wire 80 to be carried through the dryer section. Since, in the last extended nip $NP_2$, the lower element is a relatively smooth transfer belt 50 which does not receive water to a substantial extent, and the upper element is a "rougher" press fabric 40 that receives water, such as a press felt, after the nip $NP_2$ the roughness of the upper face $W_y$ of the web W unavoidably becomes substantially higher than the roughness of the lower face $W_a$. The difference in roughness is equalized by means of the equalizing nip $N_3$,$NP_3$ in accordance with the invention by pressing the top side $W_y$ of the web W against a smooth face 65',60,201.

As shown in FIG. 1, the equalizing press nip $N_3$ is formed between an upper smooth-faced 65' press roll 65 and a lower smooth-faced or hollow-faced 56' press roll 56. The surface energy and the adhesion of the smooth face 65' of the upper roll 65 have been selected considerably lower than those of the outer face of the transfer belt 50, so that the web W follows the transfer belt 50 after the nip $N_3$. For cleaning of the smooth-faced upper roll 65 and for removal of broke, a doctor, a wash jet and a broke trough 67 are used. The press roll 65 may be heated by means of prior art heating devices 68, examples of which include inside steam heating, hot-water heating through a drilled roll mantle, and outside infrared or induction heating. The elevated temperature of the face of the press roll 65 intensifies the smoothing of the roughness of the face of the web W that is placed at the side of the roll.

Figure 2:
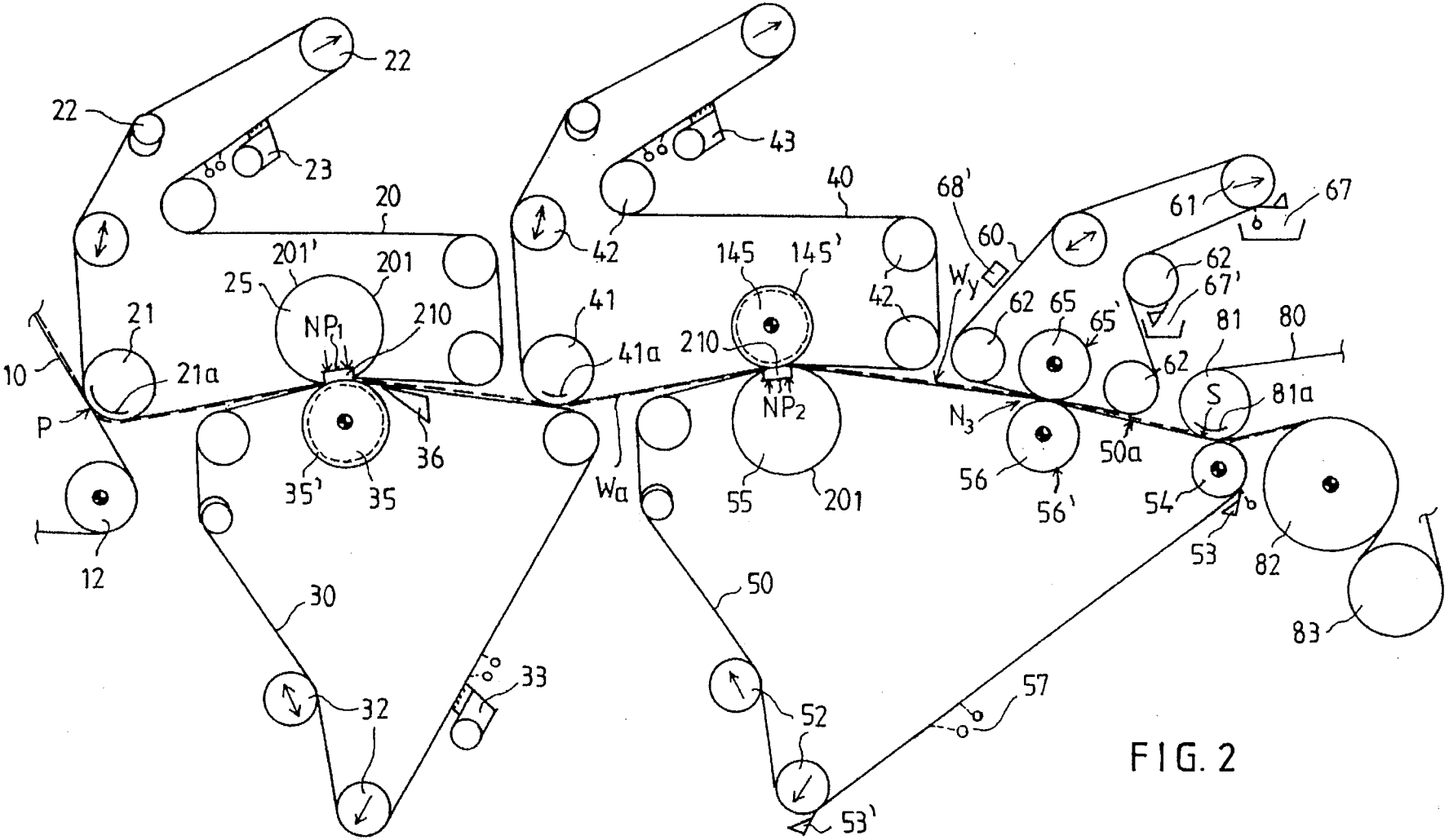
FIG. 2 is an illustration similar to FIG. 1 of a press section in accordance with the invention in which, compared with FIG. 1, additionally a press belt runs through the equalizing press of roll nip type.

The equalizing press nip $N_3$ shown in FIG. 2 is also of the roll type. Through the nip $N_3$, at the top, a particular non-permeable equalizing belt 60 that does not receive water has been arranged to run, the outer face of which belt is quite smooth. The equalizing belt 60 is guided by alignment and tensioning rolls 61 and by guide rolls 62. The surface energy of the outer face of the equalizing belt 60 and the adhesion of that face to the web W are lower than those of the outer face of the transfer belt 50, so that after the nip $N_3$ the web W follows the transfer belt 50. For cleaning of the equalizing belt 60 and for removal of broke, a doctor, a wash jet and a broke trough 67 as well as the doctor and the trough 67' of the guide roll 62 are used. The surface temperature of the equalizing belt 60 can also be raised, for example, by means of an infrared heater 68'.

Figure 3A:
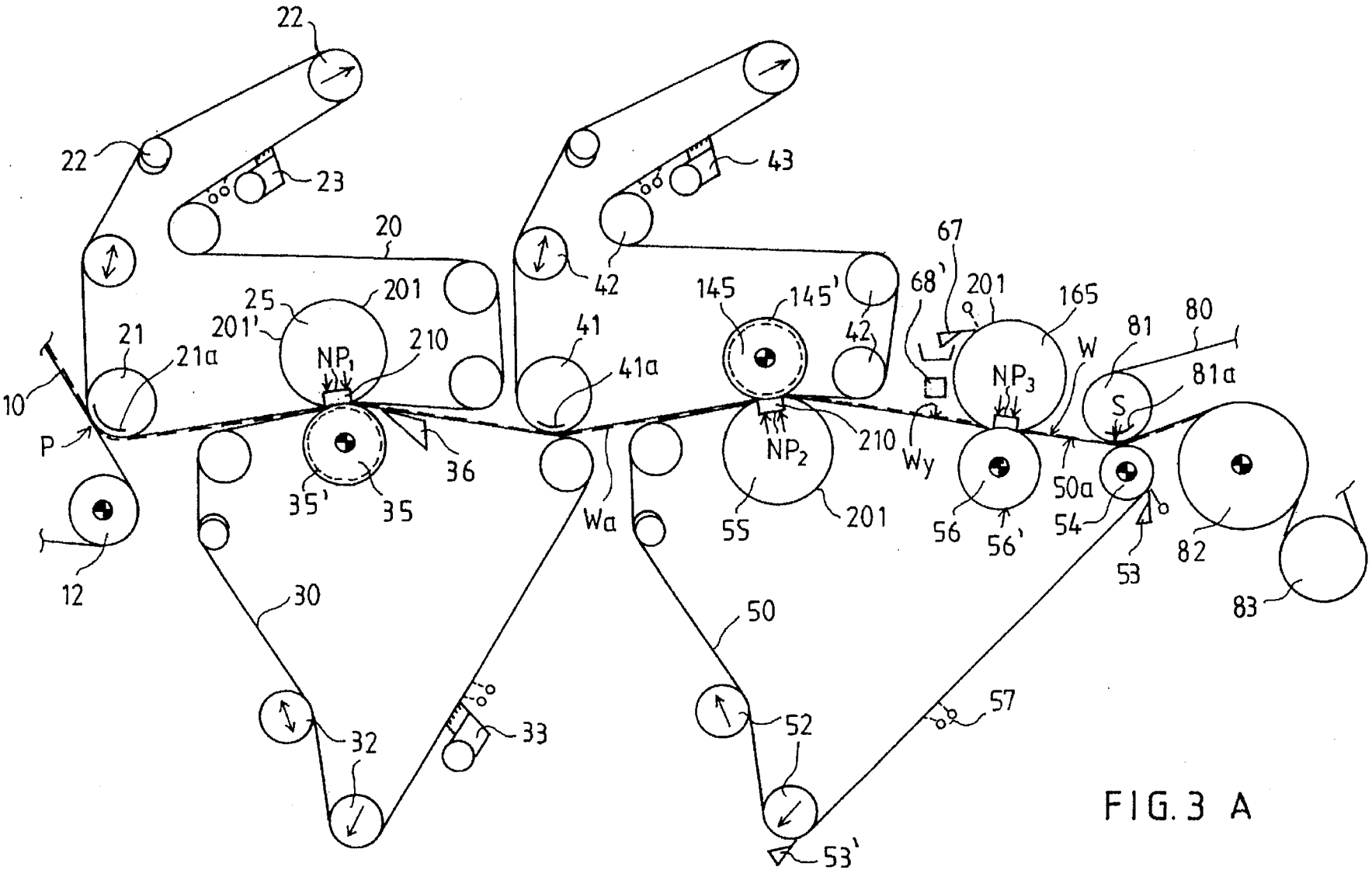
FIG. 3A is an illustration similar to FIGS. 1 and 2 of a press section in accordance with the invention in which there is an extended-nip press as the equalizing press.

In FIG. 3A, the equalizing press nip $NP_3$ placed after the press nip $NP_2$ is of the extended-nip type. The extended nip $NP_3$ is formed between the upper extended-nip roll 165 and the lower smooth-faced 56' press roll 56. The extended-nip zone is formed between the press shoe 210 and the roll face 56'. In the roll 165, there is a hose mantle 201 provided with a smooth outer face, whose surface energy is lower than that of the outer face of the transfer belt 50, so that, after the equalizing step taking place in the nip $NP_3$, the web W follows the lower transfer belt 50. For cleaning of the hose mantle 201 and for removal of broke, a doctor, a wash jet and a broke trough 67 are used. The surface temperature of the hose mantle 201 can also be raised, for example, by means of an infrared heater 68'.

Figure 3B:
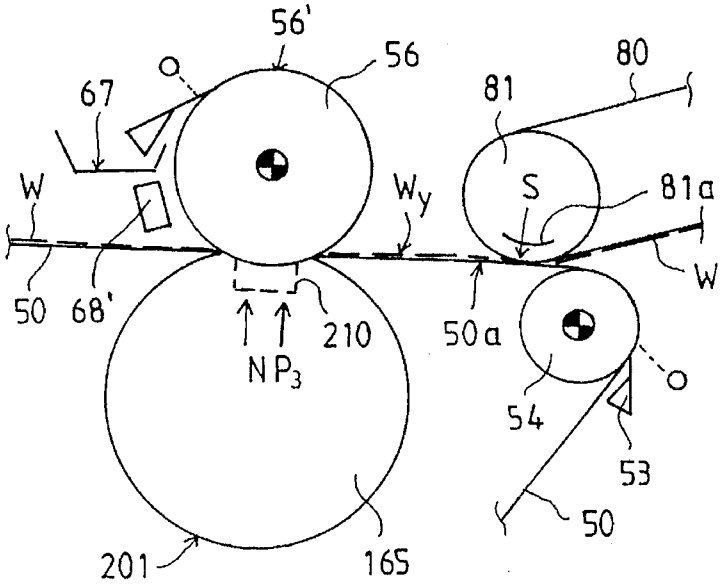
FIG. 3B shows a modification of the extended-nip equalizing press of a press section as shown in FIG. 3A.

FIG. 3B shows a modification of the equalizing press nip $NP_3$ shown in FIG. 3A. The equalizing nip $NP_3$ shown in FIG. 3B differs from the corresponding equalizing press nip $NP_3$ shown in FIG. 3A in the respect that, in FIG. 3B, the extended-nip roll 165 provided with a hose mantle 201 is placed underneath, i.e., inside the loop of the transfer belt 50, and the smooth-faced 56' "rigid" press roll 56 is placed above. The upper press roll 56 is provided with an infrared heater 68', a doctor, a wash jet, and with a broke trough 67 placed in their connection.

Figure 4A:
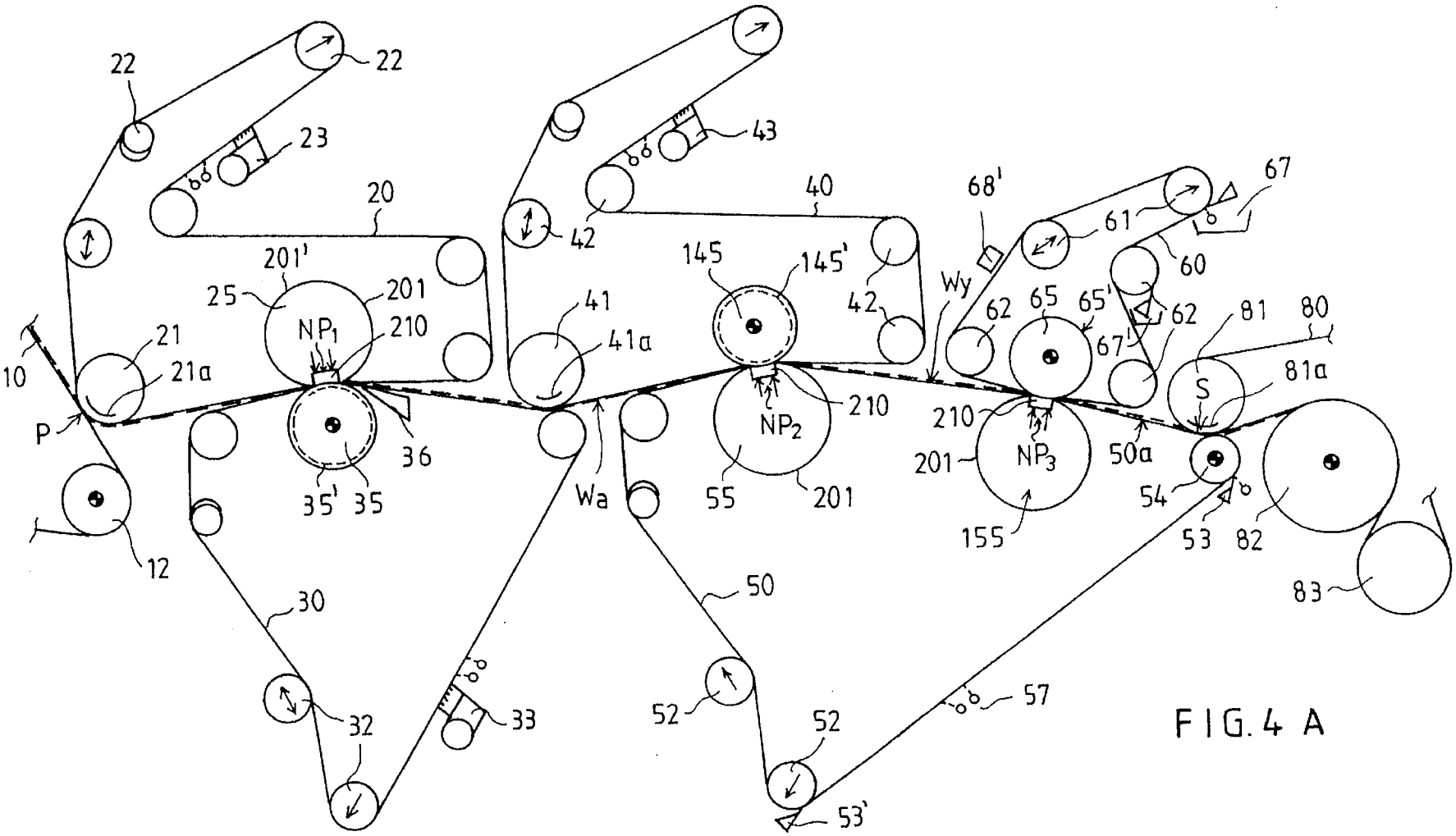
FIG. 4A shows such a variation of the press section as shown in FIG. 3 in which the extended-nip press that operates as an equalizing press is provided with a separate press-belt loop.

In FIG. 4A, the equalizing press nip $NP_3$ is also of the extended-nip type. In the nip $NP_3$, the lower roll 155 is a roll provided with a smooth hose mantle 201, and the upper roll is a smooth-faced 65' press roll 65, around which, additionally, an equalizing belt 60 similar to that described above and running through the nip $NP_3$ is fitted. The equalizing belt 60 is guided by guide rolls 62 and by alignment and tensioning rolls 61. The smooth outer face of the equalizing belt 60 has a surface energy lower than that of the outer face of the transfer belt 50, so that after the nip $NP_3$ the web W follows the transfer belt 50. For cleaning of the equalizing belt 60 and for removal of broke, a doctor, a wash jet, and a broke trough 67 are used. Also on the guide roll 62, there is a doctor and a trough 67' in its connection.

Figure 4B:
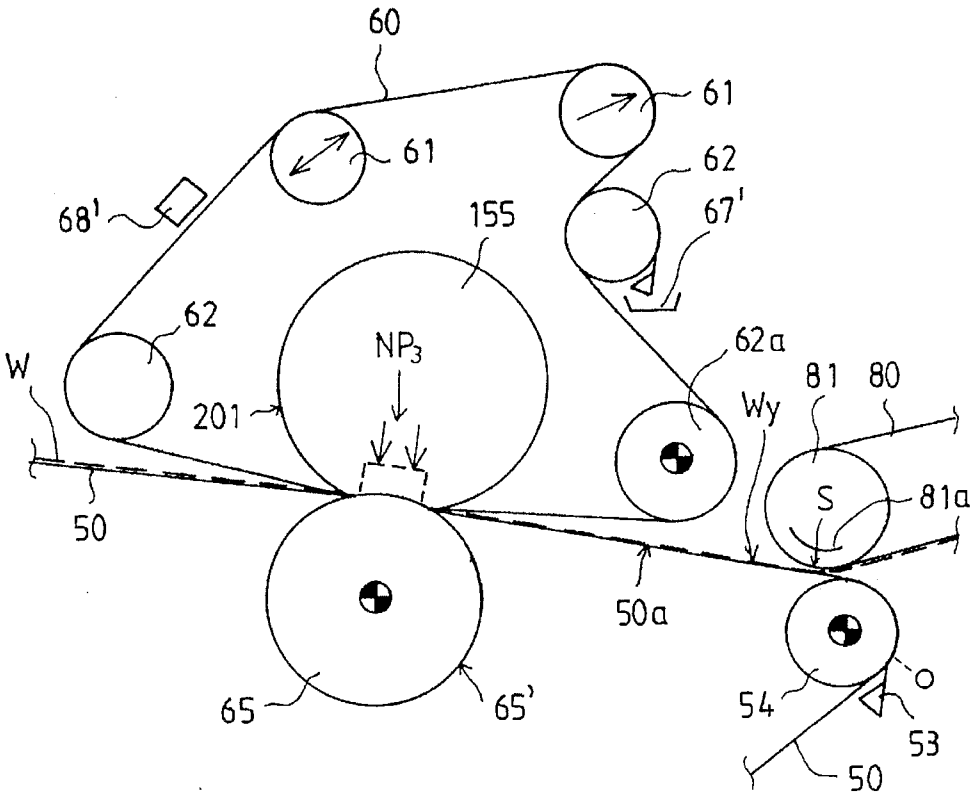
FIG. 4B shows a modification of the extended-nip equalizing press of a press section as shown in FIG. 4A.

FIG. 4B shows a modification of the extended-nip equalizing press $NP_3$ shown in FIG. 4A. FIG. 4B differs, in respect of the extended nip $NP_3$, from the corresponding extended nip shown in FIG. 4A in the respect that, in FIG. 4B, the lower press component is a smooth-faced 65' "rigid" press roll 65, which is thus placed inside the transfer-belt loop 50. The upper press component in the equalizing press nip $NP_3$ is an extended-nip roll 155 provided with a smooth hose mantle 201, around which roll an equalizing belt 60 runs, which has been arranged in a way similar to FIG. 4A and whose latter guide roll **62*a*** is preferably a driven roll.

After the third nip $N_3$,$NP_3$, the web W is transferred on the lower fabric 50 onto a concave transfer sector S, where there is the suction zone **81*a* of the suction roll 81, with whose aid the web W is transferred as a closed and substantially straight draw onto the drying wire 80**.

In the equalizing press $N_3$,$NP_3$ arranged in accordance with the present invention, it is a substantially novel feature that, after the equalizing press $N_3$,$NP_3$, the transfer belt 50 runs as a considerably long straight run **50*a* onto the transfer-belt drive roll 54. In the illustrated embodiments, the most essential drive points of various rolls are indicated. There may also be other drive points, for example for the pick-up roll and the transfer-suction roll. By means of regulation of the speed of the drive of the drive roll 54, it is possible to stretch the portion 50*a* of the transfer belt 50 placed between the equalizing nip $N_3$,$NP_3$ and the drive roll 54 so that the elongation of the web W taking place in the equalizing nip $N_3$,$NP_3$ can be compensated for and the run of the web W be kept tight after the equalizing nip $N_3$. The straight joint run 50*a* of the transfer belt 50 and the web W also provides the advantage that on this run it is possible to arrange a concave suction-transfer zone S, which is concave in relation to a paper-side face of the transfer belt, on which the web W is transferred reliably and along an almost linear path onto the drying wire 80**, i.e., with a minimal turning angle in the transfer sector S from the transfer belt to the drying wire. The effect of the equalizing press on equalization of the roughness of the web W can also be regulated by means of hardnesses of the faces that press the web W. The ability of a harder material to reduce roughness is better than that of a softer material. Thus, when press nip $NP_2$ is arranged such that the web is provided with a different roughness on one face of the web than on the other face of the web, the rougher side of the web can be pressed in the equalizing press nip $N_3$ by a material whose hardness is higher than the hardness of the press material at the smoother side of the web.

As comes out from the above, the web W has a closed and supported draw when it moves from the pick-up point P of the forming wire 10 to the point S, where it is transferred onto the drying wire 80 of the dryer section and further as a supported single-wire draw at least through the first dryer group. The circumstance that, after each nip, the web W follows the fabric that is supposed to carry the web further is ensured by means of various suction or foil devices, by means of covering angles of the press fabrics, and/or by means of the adhesion properties of the fabrics. Of these devices, the suction boxes 36 are shown in the illustrated embodiments.

Figure 5:
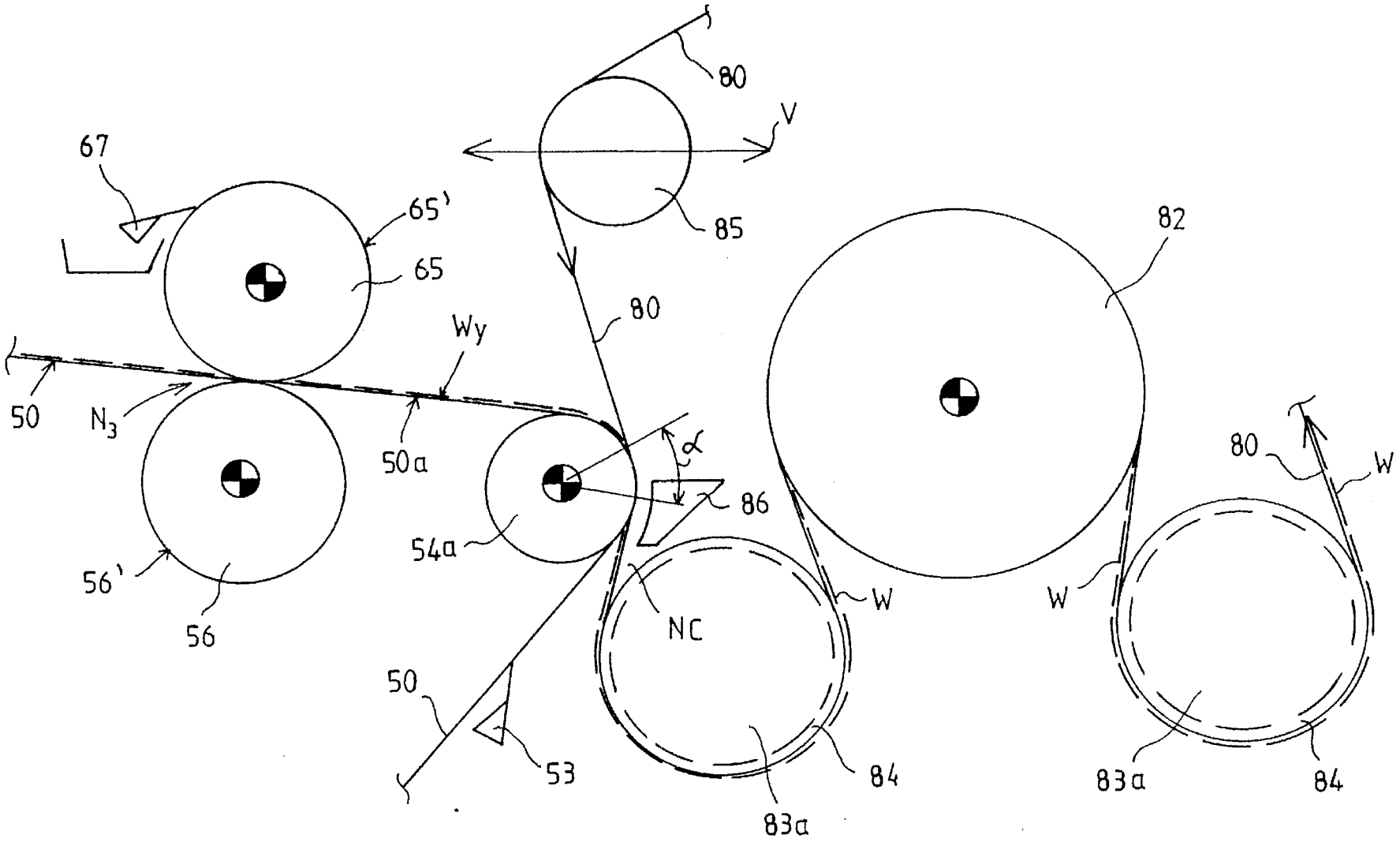
FIG. 5 shows a solution alternative to FIGS. 1–4 for passing the web from the transfer belt to the dryer section.

FIG. 5 shows a particularly advantageous embodiment, as an alternative to the embodiment in FIGS. 1–4, for passing the web W after the equalizing press nip $N_3$ from the transfer belt 50 onto the drying wire 80 of the dryer section and on the drying wire further through the first group with single-wire draw in the dryer section. FIG. 5 shows an embodiment in connection with an equalizing nip $N_3$ as shown in FIG. 1, but it should be emphasized that a closed draw of the web W as shown in FIG. 5 is equally well suitable for use in the press sections shown in FIGS. 2, 3 and 4.

As shown in FIG. 5, after the equalizing nip $N_3$, the transfer belt 50 is passed over the driven guide roll 54*a*. The drying wire 80 is guided by means of a guide roll 85 of adjustable position (the adjustment thereof being represented by arrow V) so that it contacts the web W running over the guide roll 54*a* within the transfer sector α of the guide roll 54*a*, i.e., there is a joint run of the drying wire, transfer belt 50 and web W in sector α. On the transfer sector α, the drying wire 80 presses the web W against the guide roll 54*a*, whereby the web W is transferred reliably to the drying wire 80 and is separated from the transfer belt 50. After the transfer sector α, the drying wire 80 and the web W are passed over a reversing cylinder 83*a*, preferably a suction cylinder marketed by the assignee under the trade mark VAC-ROLL™. The grooved outer mantle face 84 of the reversing cylinder 83*a* is subjected to a vacuum. In order to prevent pressures induced in the closing nip space NC between the reversing cylinder 83*a* and the drying wire 80 after the transfer sector α, in the nip space NC, a blow box 86 is arranged to produce a vacuum, for example a blow box marketed by the assignee under the trade mark UNO RUN BLOW BOX™ or equivalent. The magnitude of the transfer sector α is preferably arranged adjustable by changing the position of the guide roll 85 (arrow V). In the threading position, the magnitude of the sector α is generally selected in the range of about 5° to about 45°, and during constant running the sector α is selected in the range of about 0° to about 15°. The transfer of the guide roll 85 can be arranged in a way in itself known, for example, by means of hydraulic or pneumatic cylinders.

From FIGS. 1–4, it can be concluded directly that the run of the web W to be pressed through the press section is highly linear without major bends. Owing to the almost linear path of running of the web, the dynamic forces applied to the web remain sufficiently low in view of minimizing the risk of breaks. The magnitude of an angle of change in direction of the web W is in preferred embodiments in the range of from about 5° to about 30° and, most often, less than about 15°. An exception from this may be constituted by the pick-up roll 21 and by its suction zone, in which even a high vacuum can be employed locally.

In the press constructions described above, an almost linear closed draw of the paper web W is accomplished so that it has been possible to minimize the dynamic forces applied to the web W and the risks of breaks. Thus, the runnability is satisfactory even at high speeds (i.e., from about 30 to 40 meters per second). Moreover, by using extended nips $NP_1$ and $NP_2$ provided with hose rolls in the press section in accordance with the present invention, it has been possible to guarantee an adequate dewatering capacity and dry solids content even at high speeds without applying pressing stages of excessively high peak pressures to the web W.

The invention can also be applied to other press sections provided with supported transfer of the web, besides those described above by way of example. One alternative environment of application of the invention is, for example, the press section marketed with the trade mark "Center-Belt"™.

The examples provided above are not meant to be exclusive. Many other variations of the present invention would be obvious to those skilled in the art, and are contemplated to be within the scope of the appended claims.

I claim:

1. A press section in a paper machine in which a paper web has a closed and supported draw, comprising at least first and second separate press nips successively structured and arranged in a running direction of the web such that the web after passing through said second nip has a different roughness on one side thereof than on the other side thereof, first means for passing the web into said first press nip and between said first press nip and said second press nip, a third press nip separate from said second press nip arranged after said second press nip in the running direction of the web, said third press nip constituting an equalizing nip, second means for passing the web from said second press nip through said equalizing nip, said second web passing means comprising a substantially non-water-receiving transfer belt carrying the web on the less rough side thereof and having a first substantially straight run between said second press nip and said equalizing nip and a second substantially straight run after said equalizing nip in a direction which is substantially the same direction as said first run, said equalizing nip comprising a non-water-receiving press member having a smooth surface structured and arranged to directly contact the web on the rougher side thereof, and such that elongation of the web in the running direction of the web occurs in said equalizing nip, and regulation means for regulating a running speed of said transfer belt to stretch said second substantially straight run of said transfer belt to compensate for the elongation of the web in said equalizing nip.

2. The press section of claim 1, wherein said regulation means are structured and arranged to provide said transfer belt with variable speeds, a higher speed when compensation for elongation of the web is required.

3. The press section of claim 1, wherein said regulation means comprise a transfer-belt drive roll, said transfer belt having a transfer sector arranged after said second run which is concave in relation to a paper-side face of said transfer belt after said equalizing nip and before said drive roll, the web being transferred with a minimal turning angle in said transfer sector from said transfer belt to a drying wire of a dryer section following the press section.

4. The press section of claim 1, wherein said equalizing nip comprises a pair of smooth-faced press rolls in nip-defining relationship.

5. The press section of claim 1, wherein said non-water-receiving press member of said equalizing nip comprises an equalizing-band loop, further comprising guide means for guiding said equalizing-band loop to run through said equalizing nip into contact with the web on the rougher side of the web.

6. The press section of claim 1, wherein said equalizing press is an extended-nip press.

7. The press section of claim 6, wherein said non-water-receiving press member of said equalizing nip comprises a smooth-faced hose roll arranged on the rougher side of the web and including at least one press shoe and loading means for loading said at least one press shoe, said extended-nip press being formed by said hose roll and a press roll arranged in nip-defining relationship with said hose roll and inside a loop of said transfer belt.

8. The press section of claim 6, wherein said non-water-receiving press member of said equalizing nip comprises a smooth-faced press roll arranged on the rougher side of the web and said extended-nip press is formed by said hose roll and a smooth-faced hose roll in nip-defining relationship with said press roll and inside a loop of said transfer belt, said hose roll including at least one press shoe and loading means for loading said at least one press shoe against said press roll.

9. The press section of claim 6, wherein said extended-nip press comprises a hose roll arranged inside a loop of said transfer belt and a press roll arranged in nip-defining relationship with said hose roll and on the rougher side of the web, said non-water-receiving press member of said equalizing nip comprising an equalizing band, further comprising guide means for guiding said equalizing band in a loop around said press roll.

10. The press section of claim 6, wherein said extended-nip press comprises a press roll arranged inside a loop of said transfer belt and a hose roll arranged in nip-defining relationship with said press roll and on the rougher side of the web, said non-water-receiving press member of said equalizing nip comprising an equalizing band, further comprising guide means for guiding said equalizing band in a loop around said hose roll.

11. The press section of claim 3, wherein said first run of said transfer belt is substantially horizontal, the web being transferred on a top face of said transfer belt as a substantially straight run from said second press nip to after said equalizing press nip and further as a straight run of substantially the same direction to said transfer sector.

12. The press section of claim 1, further comprising heating means for heating said smooth press element to intensify reduction of the roughness of the rougher side of the web.

13. The press section of claim 1, wherein said non-water-receiving press member is made of a material whose hardness is higher than the hardness of the press material at the smoother side of the web.

14. A press section of a paper machine, to which a paper web to be dewatered by pressing is brought from a pick-up point of a former of the paper machine and from which the web is passed to a dryer section of the paper machine, comprising means for passing the web from the pick-up point of the former through the press section to the dryer section in a closed and substantially straight draw, said means comprising a plurality of press fabrics and a substantially non-water-receiving transfer belt, a press-fabric press-roll assembly comprising a plurality of rolls for forming first and second successively arranged press nips which dewater the web, said first and second press nips being structured and arranged such that after said second press nip, the web has a different roughness on one side thereof than on the other side thereof, the web being passed through said first and second press nips on support of at least one of said fabrics and said transfer belt, at least one of said first and second press nips being an extended-nip formed between a band roll and press roll, a third press nip arranged after said second press nip in the running direction of the web and separate from said second press nip, said third press nip constituting an equalizing nip, said plurality of press fabrics and said transfer belt comprising a first upper fabric which operates as a pick-up fabric to receive the web at the pick-up point and as an upper press fabric in said first nip, a first lower fabric which operates as a lower press fabric in said first press nip, and a second upper fabric onto which the web is transferred as a closed draw from said first lower fabric after said first press nip and which carries the web into said second press nip, and said transfer belt operating as a lower fabric in said second press nip and passing the web through said equalizing nip and further to the dryer section as a closed substantially linear run, said equalizing nip comprising a non-water-receiving press member having a smooth outer face and structured and arranged to directly contact the web on the rougher side thereof, and such that elongation of the web in the running direction of the web occurs in said equalizing nip, and regulation means for regulating a running speed of said transfer belt to stretch said transfer belt after said equalizing nip to compensate for the elongation of the web in said equalizing nip.

15. The press section of claim 14, further comprising heating means for heating said non-water-receiving press element of said equalizing nip to intensify reduction of the roughness of the rougher side of the web.

16. The press section of claim 14, wherein said non-water-receiving press member is made of a material whose hardness is higher than the hardness of the press material at the smoother side of the web.

17. The press section of claim 14, wherein said regulation means comprise a transfer belt drive roll, the drying wire running over a sector of said transfer belt drive roll and the web being transferred from said transfer belt to the drying wire in said sector.

18. The press section of claim 17, further comprising a movable drying-wire guide roll over which the drying wire runs before receiving the web in said transfer sector and moving means for moving said drying-wire guide roll, said transfer sector being adjustable upon movement of said drying-wire guide roll via said moving means and between a threading position and a position of constant running of the web.

19. The press section of claim 17, further comprising a reversing suction cylinder or roll provided with a grooved face subjected to a vacuum, the web being passed after said transfer sector on the drying wire over said reversing suction cylinder or roll onto a first drying cylinder in the dryer section.

20. The press section of claim 19, further comprising a blow box arranged in a nip space defined between said reversing cylinder or roll and the drying wire after said transfer sector, said blow box preventing or at least substantially reducing formation of pressures induced in the nip space that interfere with support contact of the web on the drying wire.

21. A press section in a paper machine in which a paper web has a closed and supported draw, comprising at least first and second separate press nips successively arranged in a running direction of the web, said second press nip being structured and arranged to provide the web with a different roughness on a first face of the web than on a second face of the web opposed to said first face of the web whereby said first face of the web is rougher than said second face of the web, first means for passing the web into said first press nip and between said first press nip and said second press nip, a third press nip separate from said second press nip arranged after said second press nip in the running direction of the web, said third press nip constituting an equalizing nip structured and arranged to cause elongation of the web in the running direction of the web, said equalizing nip comprising a smooth press element placed against said first face of the web and heating means for heating said smooth press element to intensify reduction of the roughness of said first face of the web, second means for passing the web from said second press nip through said equalizing nip, said second web passing means comprising a substantially non-water-receiving transfer belt having a first substantially straight run between said second press nip and said equalizing nip and a second substantially straight run after said equalizing nip in a direction which is substantially the same direction as said first run, and regulation means for regulating a running speed of said transfer belt to compensate in said second run of said transfer belt for the elongation of the web in said equalizing nip.

22. A press section in a paper machine in which a paper web has a closed and supported draw, comprising at least first and second separate press nips successively arranged in a running direction of the web, said second press nip being structured and arranged to provide the web with a different roughness on a first face of the web than on a second face of the web opposed to said first face of the web whereby said first face of the web is rougher than said second face of the web, first means for passing the web into said first press nip and between said first press nip and said second press nip, a third press nip separate from said second press nip arranged after said second press nip in the running direction of the web, said third press nip constituting an equalizing nip structured and arranged to cause elongation of the web in the running direction of the web, said equalizing nip being structured and arranged such that said first face of the web is directly pressed in said equalizing nip by a press material whose hardness is higher than the hardness of the press material directly pressing said second face of the web, second means for passing the web from said second press nip through said equalizing nip, said second web passing means comprising a substantially non-water-receiving transfer belt having a first substantially straight run between said second press nip and said equalizing nip and a second substantially straight run after said equalizing nip in a direction which is substantially the same direction as said first run, and regulation means for regulating a running speed of said transfer belt to compensate in said second run of said transfer belt for the elongation of the web in said equalizing nip.

23. A press section of a paper machine, to which a paper web to be dewatered by pressing is brought from a pick-up point of a former of the paper machine and from which the web is passed to a dryer section of the paper machine, comprising means for passing the web from the pick-up point of the former through the press section to the dryer section in a closed and substantially straight draw, said means comprising a plurality of press fabrics and a transfer belt, a press-fabric press-roll assembly comprising a plurality of rolls for forming first and second successively arranged press nips which dewater the web, the web being passed through said first and second press nips on support of at least one of said fabrics and said transfer belt, at least one of said first and second press nips being an extended-nip formed between a band roll and press roll, said second press nip being structured and arranged to provide the web with a different roughness on a first face of the web than on a second face of the web opposed to said first face of the web whereby said first face of the web is rougher than said second face of the web, and a third press nip arranged after said second press nip in the running direction of the web and separate from said second press nip, said third press nip comprising an equalizing nip structured and arranged to cause elongation of the web in a running direction of the web and regulation means for regulating a running speed of said transfer belt to compensate for the elongation of the web in said equalizing nip, said equalizing nip comprising a smooth press element placed against said first face of the web and heating means for heating said smooth press element to intensify reduction of the roughness of said first face of the web, said plurality of press fabrics and said transfer belt comprising a first upper fabric which operates as a pick-up fabric to receive the web at the pick-up point and as an upper press fabric in said first nip, a first lower fabric which operates as a lower press fabric in said first press nip, and a second upper fabric onto which the web is transferred as a closed draw from said first lower fabric after said first press nip and which carries the web into said second press nip, and said transfer belt operating as a lower fabric in said second press nip and passing the web through said equalizing nip and further to the dryer section as a closed substantially linear run.

24. A press section of a paper machine, to which a paper web to be dewatered by pressing is brought from a pick-up point of a former of the paper machine and from which the web is passed to a dryer section of the paper machine, comprising means for passing the web from the pick-up point of the former through the press section to the dryer section in a closed and substantially straight draw, said means comprising a plurality of press fabrics and a transfer belt, a press-fabric press-roll assembly comprising a plurality of rolls for forming first and second successively arranged press nips which dewater the web, the web being passed through said first and second press nips on support of at least one of said fabrics and said transfer belt, at least one of said first and second press nips being an extended-nip formed between a band roll and press roll, said second press nip being structured and arranged to provide the web with a different roughness on a first face of the web than on a second face of the web opposed to said first face of the web whereby said first face of the web is rougher than said second face of the web, and a third press nip arranged after said second press nip in the running direction of the web and separate from said second press nip, said third press nip comprising an equalizing nip structured and arranged to cause elongation of the web in a running direction of the web and regulation means for regulating a running speed of said transfer belt to compensate for the elongation of the web in said equalizing nip, said equalizing nip being structured and arranged such that said first face of the web is directly pressed in said equalizing nip by a press material whose hardness is higher than the hardness of the press material directly pressing said second face of the web, said plurality of press fabrics and said transfer belt comprising a first upper fabric which operates as a pick-up fabric to receive the web at the pick-up point and as an upper press fabric in said first nip, a first lower fabric which operates as a lower press fabric in said first press nip, and a second upper fabric onto which the web is transferred as a closed draw from said first lower fabric after said first press nip and which carries the web into said second press nip, and said transfer belt operating as a lower fabric in said second press nip and passing the web through said equalizing nip and further to the dryer section as a closed substantially linear run.

* * * * *